United States Patent [19]

Besik et al.

[11] 3,996,862

[45] Dec. 14, 1976

[54] WASTE DISPOSAL SYSTEM

[75] Inventors: Ferdinand Besik, Mississauga; Anant S. Deshpande, Oakville, both of Canada

[73] Assignee: Ontario Research Foundation, Sheridan Park, Canada

[22] Filed: Feb. 10, 1976

[21] Appl. No.: 656,798

[30] Foreign Application Priority Data

Feb. 13, 1975 United Kingdom ..... 6205/75

[52] U.S. Cl. ..... 110/10; 110/8 A; 110/8 C; 110/119

[51] Int. Cl.[2] ..... F22B 33/18; F23G 5/12

[58] Field of Search ..... 110/8 R, 8 A, 8 C, 7 R, 110/10, 18 R, 18 C, 119

[56] References Cited

UNITED STATES PATENTS

| | | | |
|---|---|---|---|
| 3,208,411 | 9/1965 | Urban et al. | 110/10 |
| 3,557,725 | 1/1971 | Stookey | 110/10 |
| 3,559,597 | 2/1971 | Heiny | 110/10 |
| 3,680,501 | 8/1972 | Szilagyi et al. | 110/10 |
| 3,861,334 | 1/1975 | Stockman | 110/10 |

*Primary Examiner*—Kenneth W. Sprague
*Attorney, Agent, or Firm*—Sim & McBurney

[57] ABSTRACT

An on-site waste disposal system utilizes controlled incineration of solid wastes and economic heat recovery from flue gases to dispose of solid wastes from a high population dwelling area, such as an apartment building, to decrease substantially the volume and mass of solid wastes to be disposed of and provide a cool clean flue gas. The heat generated by the self-sustaining combustion of the solid wastes is used to heat hot water for the apartment building and, preferably purify waste water from an on-site sewage treatment system.

10 Claims, 7 Drawing Figures

WASTE DISPOSAL SYSTEM

FIELD OF INVENTION

This invention relates to the disposal of wastes, typically domestic wastes, and the economic utilization of heat generated in the waste disposal.

BACKGROUND TO THE INVENTION

Domestic waste materials represent a continuing and growing disposal problem due to urban growth and lack of suitable land fill sites. Collection and transportation of domestic wastes from individual and multi-unit dwellings involves a considerable expense. Attempts have been made to incinerate such wastes to remove the combustible and putrescible content and in order to decrease the land fill requirements of the resulting ash. Such incineration procedures have involved the use of large excesses of air in the combustion, have involved the discharge of high temperature flue gases to atmosphere and have resulted in the discharge of high levels of pollutants, particularly particulate solids.

Further, domestic solid wastes usually contain a high proportion of food and other putrescible wastes, which dictate the establishment of land-fill sites remote from habitation, increasing further the expense of transportation.

Additionally, domestic wastes typically have an appreciable calorific value, generally in excess of 4,000 BTU/lb., due to the large proportion of combustible material present in the wastes, and hence the disposal thereof as land fill or the incineration thereof with discharge of the resulting flue gas represent a loss of a potential energy source.

There have been attempts to recover energy from solid wastes but such attempts generally have been confined to the generation of steam for in-plant use or for sale. Such steam generators, however, are quite sophisticated and, hence, expensive. Further, such generators must have markets for the steam they produce in order to be effective in resource recovery.

As far as we are aware, no attempts have been made to provide an on-site waste disposal system for a concentrated population housing development, such as, an apartment building, a townhouse development or a self-contained housing subdivision, which utilizes the calorific value of the waste material.

SUMMARY OF INVENTION

In accordance with the present invention, there is provided an on-site waste disposal system for use with an apartment building or the like in which all solid wastes are incinerated along with sewage sludge and waste water from an on-site sewage treatment plant, if present, the calorific value of the wastes is efficiently utilized, cooled and clean combustion gases are discharged, and water is reclaimed from the solid, liquid and sludge wastes. The incineration of the wastes decreases the solid waste to a small volume of sterile ash for ultimate disposal into a land fill or material reclamation.

The system of the present invention is designed to eliminate the cost of refuse collection, to decrease substantially the costs for ultimate disposal of solid wastes by elimination of the large volume of combustible materials and elimination of the putrescible material, to avoid air pollution from particulates and noxious gases and vapors and to decrease the need for conventional fuel required to provide hot water and space heating or cooling in the apartment building or the like.

Since the recovery and utilization of the heat occurs at the location of generation of the refuse, the heat recovery and reuse efficiencies are higher than in conventional refuse incineration systems.

The waste disposal system of the invention consists of a number of interconnected stages which are integrated into a single waste disposal unit which may be dimensioned to meet the particular operating requirements of the apartment building, or other compact high density population units, based on the population of the building. The unit may be readily installed in new or existing buildings.

DESCRIPTION OF PREFERRED EMBODIMENTS

Figure 1:
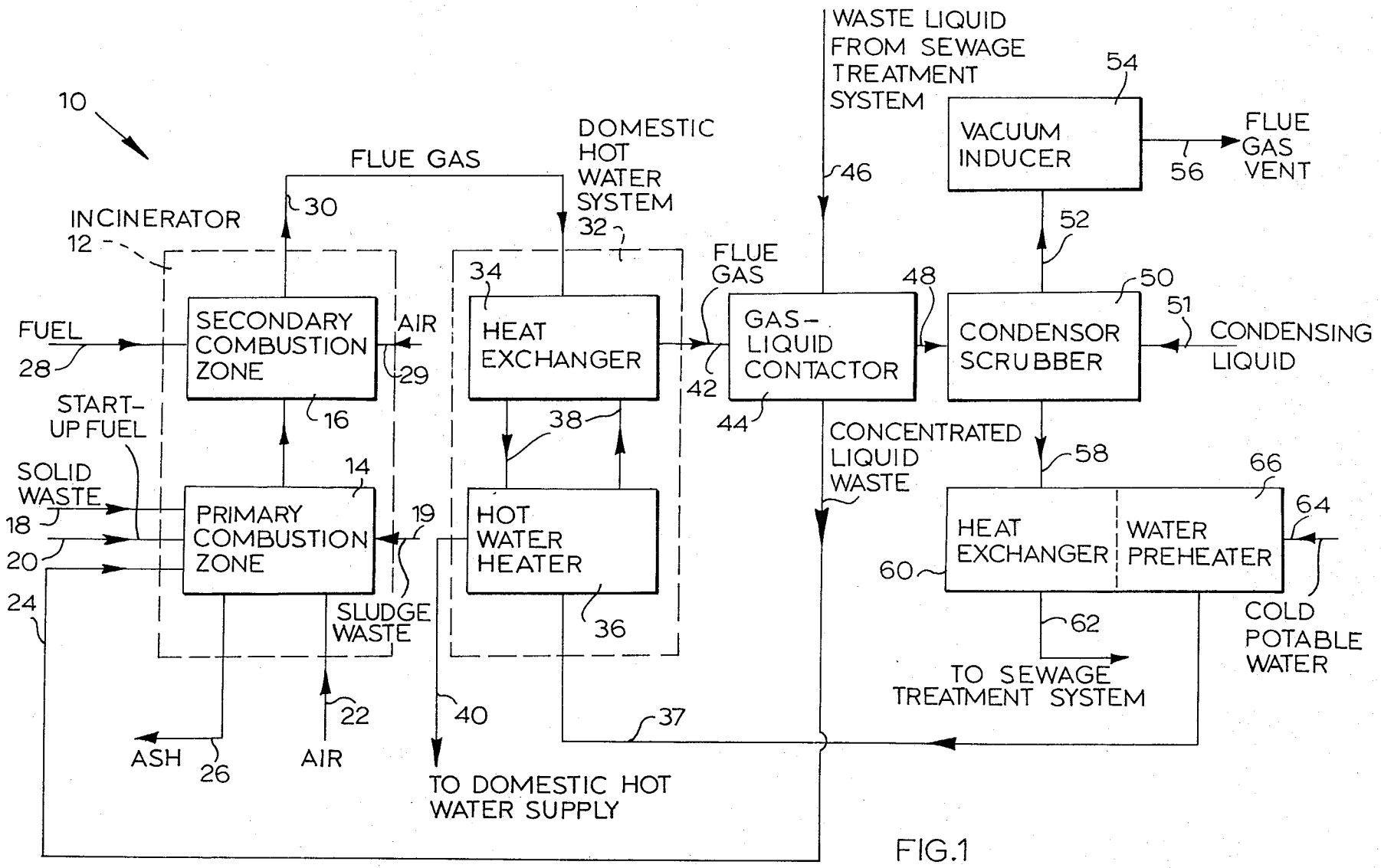
FIG. 1 is a schematic flow sheet of one embodiment of a waste treatment system according to the invention for the disposal of solid, liquid and sludge wastes.

Referring first to FIG. 1, a continuously operating waste disposal system 10 for on-site use in an apartment building includes an incinerator 12 for receipt of a mixture of solids and sludge wastes.

Solid wastes from an apartment building vary in content from time to time, depending on the people disposing of the same, the season of the year etc. but generally include paper wastes, food wastes, rubber, plastic and/or leather wastes, textile wastes, non-combustible material, and, optionally garden wastes. The moisture content and gross heating value of such waste materials also may vary depending on the relative proportions of the components. Ranges and averages of values for the components and the other parameters are set forth in the following Table I:

TABLE I

| | Range | Average |
|---|---|---|
| Paper waste wt.% | about 40 to about 65 | 46.4 |
| Food waste wt.% | about 5 to about 35 | 21.7 |
| Rubber, plastic and/or leather wastes wt.% | about 1 to about 9 | 4.6 |
| Textile wastes wt.% | about 0.1 to about 11 | 3.0 |
| Garden wastes wt.% | 0 to about 20 | 2.0 |
| Non-combustibles wt.% | about 10 to about 30 | 22.3 |
| Moisture content wt.% | about 10 to about 35 | 21.7 |
| Gross heating value BTU/lb. | about 3500 to about 6000 | 4791 |
| Bulk density lbs./cu.ft. | about 4 to about 10 | 7.0 |

The non-combustible portion of the solid waste is made up of glass, cans, ash and other non-combustible solids. Average values of these components in the non-combustible portion of the solid waste are set forth in the following Table II:

TABLE II

| | |
|---|---|
| Glass | 64.6 wt.% |
| Cans and metals | 19.8 wt.% |
| Ash | 14.8 wt.% |
| Other non-combustibles | 0.8 wt.% |

Sewage sludge waste also is incinerated.

The latter waste arrises from an on-site domestic liquid waste (sewage) treatment system which renovates the waste water from the apartment building.

In copending U.S. application Ser. No. 540,513 filed Jan. 13, 1975, now U.S. Pat. No. 3,980,556, by Ferdinand Besik for Adsorption-Biooxidation Treatment of Waste Waters to Remove Contaminants Therefrom, there is described a domestic waste water treatment procedure for the renovation of waste water. The aforementioned application discloses a multistage operation in which the waste water first is subjected to adsorption and biooxidation using activated sludge and activated carbon, then is subjected to chemical treatment and finally is subjected to polishing operations, such as multimedia filtration, disinfection and reverse osmosis to produce renovated water. This procedure also produces excess sludge and waste water for disposal. The latter sludge may constitute the sludge waste fed to the incinerator 12, and typically contains about 7 percent solids (non-combustible) and about 93 percent water.

In a preferred embodiment of the invention, the sewage waste treatment system of the above-mentioned application is combined with the waste disposal system of the invention to provide complete treatment of all wastes from the apartment building.

The incinerator 12 is a conventional refractory-lined and grateless type having fluidly interconnected primary 14 and secondary 16 combustion zones or chambers. In the primary combustion zone, the solid waste fed thereto by line 18 and the sludge waste fed thereto by line 19 are incinerated by igniting the wastes with a suitable burner fed by fuel, typically natural gas, fed by line 20. Prior shredding, compaction or other preliminary treatment of the solid waste is unnecessary.

Once self-sustaining combustion is achieved, the igniter burner is shut off and the ignited material then burns in the presence of air or other oxygen-containing gas fed by line 22. The quantity of air fed by line 22 is in excess of that theoretically required in an attempt to ensure all combustibles are oxidized, and quantities of residual unburned carbon less than about 1.5 percent are achieved.

The air fed to the primary combustion zone 14 by line 22 is delivered beneath the bed of solid waste therein through a convenient distribution system capable of providing suitable contact for efficient combustion and minimal particulate entrainment.

During the burning of the waste material, concentrated liquid waste fed by line 24 is sprayed onto the burning mass for consumption of the solids content thereof and evaporation of the aqueous content.

The uncombusted material is removed from the incinerator as a sterile ash by line 26. The ash may be used as land fill or in land reclamation. Since the volume of the combustibles in the solid waste is considerable, incineration thereof results in a considerable decrease in volume of material to be disposed of, typically a greater than 85 percent decrease in volume, with a consequent greater than 70 percent decrease in solid waste mass. The quantity of solid to be disposed of from a community using the waste disposal system 10 is considerably decreased, with consequent economic saving. Since the putrescible materials content of the solid waste is consumed by the incineration, the residual typically being less than 1 percent, the solid so disposed of is sterile and environmentally acceptable. The product thus may be disposed of in a more flexible manner than the untreated solid waste material.

The flue gas from the primary combustion zone 14 containing gaseous combustion products, including carbon dioxide, carbon monoxide, volatile hydrocarbons and entrained particulate matter, along with inert gases of the feed air, mainly nitrogen, and unused oxygen, passes to the secondary combustion zone for exposure to a heating flame fed by fuel in line 28, such as natural gas, and air fed by line 29 to cause conversion of carbon monoxide content to carbon dioxide and the hydrocarbon content to carbon dioxide.

The air fed by line 29 to the secondary combustion zone is delivered therein through a convenient distribution system providing suitable mixing for minimizing auxiliary fuel consumption and hydrocarbon emissions.

A forced draft system automatically delivers sufficient quantities of combustion air to both the primary and secondary combustion zones so that auxiliary fuel consumption and particulate emissions are minimized. Primary and secondary air proportioning and quantities may be adjusted automatically, such as by using a modulating dampers-thermocouple sensors control system.

Operation of the burners in the primary and secondary combustion zones 14 and 16 is automatically controlled to a predetermined set point by thermocouple sensors located at the outlets of the respective combustion zones.

There are many parameters of the operation of the incinerator 12 which may be varied. To achieve what is considered to be efficient operation, there should be:

1. Substantially complete combustion of combustible material;
2. Substantially complete conversion of carbon monoxide and hydrocarbon in the flue gas of the primary combustion zone 14 to carbon dioxide to result in a flue gas having an environmentally negligible concentration of carbon monoxide and hydrocarbon;
3. Minimization of fuel consumption in the secondary combustion zone; and
4. Minimization of entrained particulate solids concentration in the flue gases exiting the incinerator 12.

Prior art incineration techniques were studied and found to be lacking in at least one of these respects, usually fuel consumption and particulate solids emissions, and hence were rejected. Extensive studies were carried out on the various variables of the incinerator operation and their interrelationships, if any. As a result of these studies, a set of conditions was arrived at allowing for the first time the incineration of solids wastes in a manner meeting the above-recited criteria.

It was, therefore, determined that the excess air should be in the range of about 120 to 150 percent of the theoretical quantity required for combustion of the combustibles, resulting in an oxygen concentration in the flue gases leaving the incinerator 12 of 9 to 9.8 percent and a carbon dioxide concentration of 6.7 to 7.4 percent. It was further determined that the temperature of the secondary combustion zone should exceed about 1400° F, typically up to about 1800° F.

Under these conditions, the residual uncombusted combustibles is very low, the particulates concentration is low, fuel consumption is at its minimum and carbon monoxide and hydrocarbon concentration in the flue gas exiting the incinerator 12 are negligible. Average values of the main pollutants in the flue gas stream operating under these conditions, along with other pollutants which may arise are as follows, with the corresponding minimum air standard for the Province of Ontario, Canada:

TABLE III

| Contaminant | Average Quantity | Standard |
|---|---|---|
| Particulates | 24.8 $\mu g/m^3$ | 100 $\mu g/m^3$ |
| Carbon monoxide | 304 $\mu g/m^3$ | 6000 $\mu g/m^3$ |
| Hydrocarbons | 17.5 ppm* | 50 ppm |
| Sulphur oxides | 240 $\mu g/m^3$ | 830 $\mu g/m^3$ |
| Nitrogen oxides | 1.9 $\mu g/m^3$ | 500 $\mu g/m^3$ |

*Formed almost exclusively in ignition period.

Depending on the proportion and nature of the plastics material, the flue gas may contain hydrogen chloride and the ash removed from the incinerator also may have a small chloride concentration. The hydrogen chloride in the flue gas is removed from the system dissolved in the reclaim water in line 62.

The distribution of the air fed to the primary combustion zone 14 by line 22 between overfeed and underfeed of the solid waste material has an effect on the process of incineration. The amount of combustion air injected under the bed of waste material controls the rate of incineration since an increased quantity of underfeed combustion air supports better physical contact of oxygen with waste combustibles and increases the rate of combustion. It was found that best performance was achieved when, during initial ignition, about 25 percent of the total combustion air was distributed under the bed of waste material, while the remainder is fed over the bed, and when self-sustaining combustion was achieved, the underfeed ratio was increased to 75 to 80 percent of the air.

The retention time for oxidation of combustibles in the secondary combustion zone 16 is a function both of its geometry and the rate of incineration in the primary combustion zone 14, which, in turn, is a function of the volume of excess air. With the unit tested, at the excess air level of 120 to 150 percent, a residence time in the secondary combustion zone of about 2.5 to 2.75 seconds was achieved.

Most efficient utilization of the system occurs when the system runs continuously, with the incineration being carried out on a semicontinuous basis, so that the incinerator does not cool down substantially after one batch of waste material has been incinerated before commencement of incineration of another batch. There is, therefore, in effect a "continuous batch" feeding of solid waste to the primary combustion zone.

The feed of the solid waste to the primary combustion zone 14 may be achieved using a hydraulically operated reciprocating ram or any other convenient means.

The flue gases from conventional incineration procedures are vented to atmosphere and no attempt is made to recover the heat values. In the present invention, the heat value of the flue gases produced by the controlled incineration is utilized.

The flue gas passing out of the incinerator 12 by line 12 has the temperature of the secondary combustion zone 12 and first passes to a domestic hot water system 32 in which the hot gases are used to heat the domestic hot water system of the apartment building in which the waste disposal system 10 is installed.

The flue gases contact a heat exchanger unit 34 which is in indirect heat exchange relationship with a hot water tank 36 through a closed loop through which heat exchange liquid flows by lines 38 between the heat exchanger 34 and the hot water tank 36.

The heat exchange unit 34 may be of any convenient type, such as a low temperature water, vertical fire tube type having high heat transfer area boiler tubes situated therein.

Domestic water, preheated in an earlier step to a temperature of about 90° to about 110° F, is fed to the hot water heater 36 by line 37 and is heated by the heat delivered by the flue gases in the heat exchanger 34 and the resulting heated water is passed by line 40 to the domestic hot water supply.

The heat provided by the flue gases to the domestic hot water supply may be sufficient to provide all the heat required by the hot water system, depending on the amount of heat extracted from the flue gases, the efficiency of utilization of such heat, the hot water demand, the temperature of the feed water in line 37 and the temperature of water desired typically about 120° to about 180° F.

Even when the heat from the flue gases is unable to provide all the heat requirement of the hot water system, the recovered heat does supply a proportion of the total heat requirement, hence decreasing the external energy required for hot water heating.

The proportion of the heat present in the flue gas in line 30 used in the hot water heating system 32 may vary widely, typically about 30 to 50 percent of the total waste heat in the flue gas.

An indirect heat exchange arrangement as illustrated preferably is used in the hot water system as a safety factor. If the heat exchanger 34 should fail, through corrosion or the like, then the domestic hot water system is not contaminated by the flue gases.

The flue gases of decreased temperature, such as about 600° to 1000° F pass from the hot water system 32 by line 42 to a gas-liquid contactor 44. The temperature of the flue gas in line 42 depends on the initial temperature thereof, the temperature of the hot water in line 40 and the proportion of the heat desired to be recovered at this stage.

The flue gases in line 42 pass into the cascading chamber of a direct contact evaporator unit 44 made of corrosion and scale resistant material. Waste liquid from the waste water reclamation system is fed by line 46 to a reservoir in the lower portion of the evaporator unit 44 and is continuously recirculated to the top of the evaporator to fall against counterflowing flue gases. Direct heat and mass transfer occur in the evaporator 44 during the countercurrent contact of the flue gases and the liquid wastes, resulting in evaporation of the liquid wastes and simultaneous cooling and scrubbing of the flue gases free from dissolvable gases and removal of fly ash. When a predetermined amount of water has been evaporated from the liquid waste and a desired concentration has been reached, the concentrated liquid waste is passed from the evaporator 44 by line 24 to the incinerator 12.

The volume of waste water from the waste water treatment system may be insufficient to sustain an adequate evaporation rate in the evaporator-cooler 44 in which case external water may supplement the waste water.

The proportion of the heat of the flue gases which are utilized in the evaporation may vary widely, depending on the volume of liquid to be evaporated, the concentration of the concentrated waste water in line 24, the temperature of the input flue gases and the temperature desired in the output flue gases. Typically, about 15 to about 30 percent of the total heat is used in the evaporator unit 44.

The flue gases leaving the evaporation unit 44 are saturated with water vapor and have a temperature of about 130° to 180° F, depending on the heat utilization in the evaporation and the input temperature.

The moisture-laden and cooled flue gases are passed from the evaporator 44 by line 48 to a direct-contact type condensor/scrubber 50. The condensor 50 may be of any convenient construction to allow direct heat and mass transfer to occur between the moist flue gases and counter-flowing cooling fresh water fed by line 51, such as from a stage of the waste water treatment. Typically, the condensor/scrubber 50 is of the vertical, packed bed type through which the moisture laden flue gases and spray-fed cooling water flow countercurrently.

In the condensor/scrubber 50, the flue gases are cooled by the cooling water at a suitable temperature to a temperature below about 100° F, preferably below about 90° F, and stripped of a substantial proportion of the water collected from the liquid wastes evaporator 44. The flue gases also are effectively washed free of any particulates remaining from the evaporator 44, together with the vapors of any remaining organics and other gaseous contaminants.

It is essential that the flue gases are cooled to a temperature below about 100° F to allow their discharge to atmosphere and removal of substantially all the heat from the combustion operation. The cooling water used and the manner of countercurrent contact should be controlled to achieve cooling to below this temperature. Cooling water temperatures of about 50° to 80° F may be used.

A demister bed may be provided in the upper portion of the condensor/scrubber 50 to contact the scrubbed flue gases with a further water spray before they exit the condensor/scrubber 50 for removal of any residual suspended water particles.

The cooled and contaminant-free flue gases pass out of the condensor 50 by line 52 to a vacuum inducer 54 of any convenient construction which maintains the gaseous flow line and the incinerator 12 under a slight subatmospheric pressure, of the order of about 0.005 to about 0.1 in w.c. The flue gases are vented to atmosphere by line 56.

Reclaimed warm water is collected in the bottom condensate tank of the condensor 50 for removal from the condensor 50 by line 58. The temperature of the warm water in line 51, the latent heat present in the moisture carried by the flue gases, the initial temperature of the flue gases and the temperature of the flue gases exiting the condensor 50, typically about 90° to 120° F.

The condensing and scrubbing operations recover two different sources of heat. The first source is the latent heat of the water vapor in the flue gas stream in line 48, which in turn arises from the heat used to evaporate waste water in the gas-liquid contactor 44 and residual heat in the flue gases arising from the incineration of the solid wastes. The warm water in line 58 is passed to a heat exchanger 60 prior to passage of the cooled liquid of temperature approximately ambient to the waste water treatment system by line 62. The feed of the reclaimed water from the heat exchanger 60 by line 62 to the waste water treatment system introduces a purge from the waste disposal system 10 of hydrogen chloride and other water-soluble gases removed from the flue gases in the condensor/scrubber 50.

The heat released by the reclaimed warm water in the heat exchanger 60 is used to preheat cold potable water fed by line 64 to a water preheater 66 associated with the heat exchanger 60, prior to passage of the preheated water by line 37 to the hot water heater 36. The cold potable water typically has a temperature of about 50° to about 70° F, while the preheated water typically has a temperature of about 50° to about 70° F.

The last portion of the heat retained from the flue gases thus is recovered and used in the hot water system.

The hot flue gases leaving the incinerator 12, therefore, are used to provide heat in a number of ways. The flue gases are used to heat water for the hot water supply of the apartment building and they are used to concentrate liquid wastes by evaporation, the resulting flue gases of temperature below about 100° F being vented. The latent heat in the vapor from the evaporation itself is recovered and used to preheat the potable water heated by the flue gases for the domestic hot water supply. Thus, substantially all the heat which is recovered from the flue gases is used in heating water for use in the hot water system of the apartment building, part directly and part indirectly after use in the concentration of the liquid wastes. The overall thermal efficiency of the system, measured in terms of the heat reclaimed in the hot water divided by the sum of the heat provided by the auxiliary fuel and the heat provided by the solid waste, is about 70 to 80 percent.

The waste disposal system of FIG. 1, therefore, handles all the solid, sludge and liquid wastes from the apartment block effectively and converts them to sterile ash for easy and sanitary disposal, cool and pollutant-free flue gas and reclaimed water. The calorific value of the wastes realized on incineration is economically used.

Figure 2:
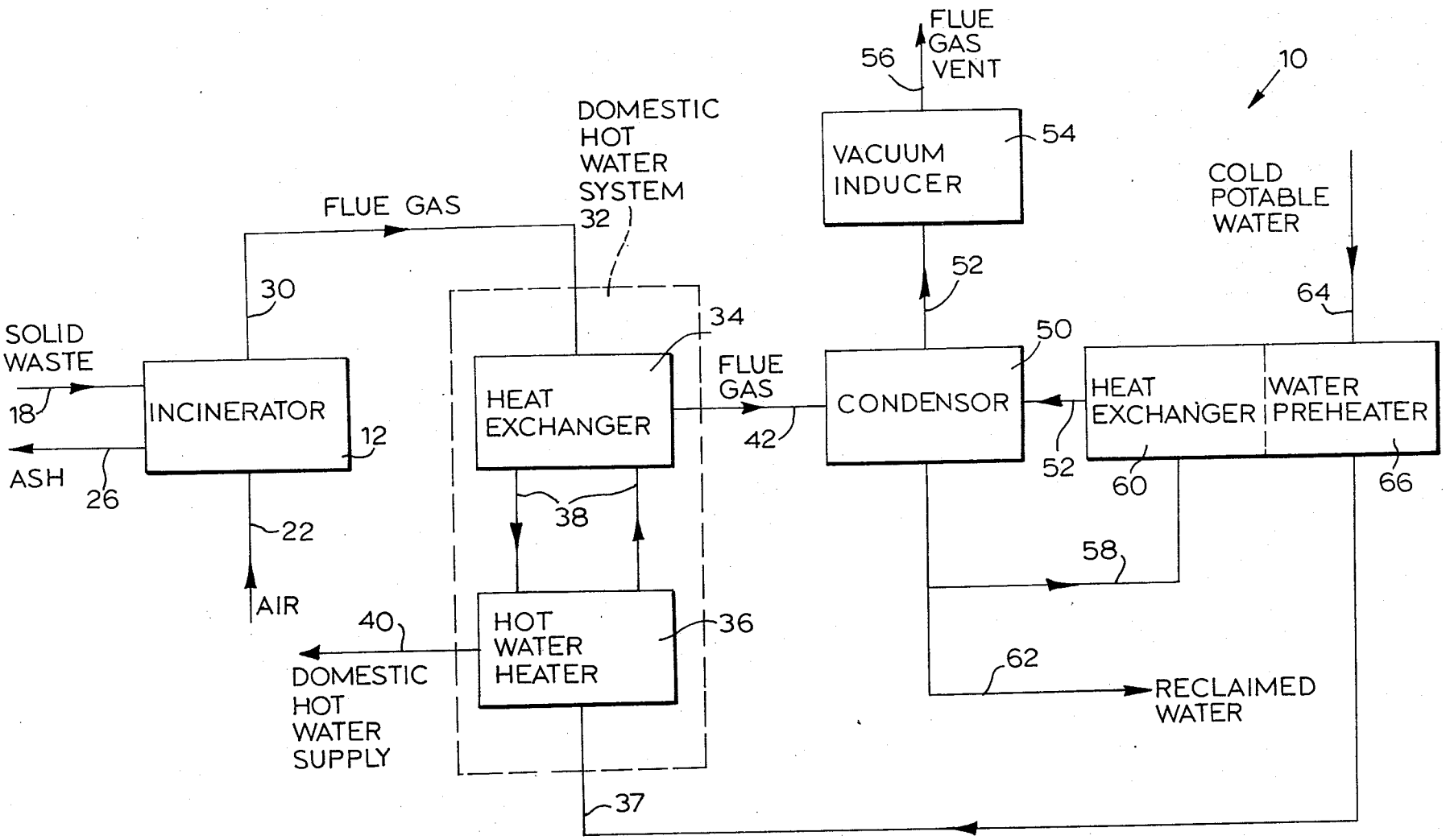
FIG. 2 is a modification of the invention of FIG. 1 utilized for the disposal of solid wastes only.

Turning now to the embodiment of FIG. 2, this embodiment is utilized where solid wastes only require on-site treatment. Such a system may be used in the absence of an on-site waste-water treatment system, such as is described above in connection with the embodiment of FIG. 1. Many elements are common to the embodiment of FIG. 1 and the same reference numerals have been used to designate the common elements.

As compared with the embodiment of FIG. 1, the embodiment of FIG. 2 omits the gas-liquid contactor-evaporator 44, the liquid waste feed 46, the concentrated liquid waste cycle 24 and the sludge waste feed.

Additionally, moisture condensed from the flue gases is partially recycled to the heat exchanger 60 and, after cooling therein, is used as the condensing liquid fed by line 52 to the condensor 50. The remainder of the condensed moisture constitutes the reclaimed water in line 62. Since, in continuous operation, the recycle streams 58 and 52 contain a fixed quantity of water, the quantity of reclaimed water in line 62 in effect is the quantity of moisture condensed from the flue gases.

The operating parameters of the incinerator 12 remain the same as discussed above in connection with the embodiment of FIG. 1, but some of the other parameters of the system are varied since there is no gas-liquid contactor to cool the flue gases and remove heat therefrom. Suitable adjustment may be made by removing more heat from the gases in the hot water system 32 and in the condensor 50.

EXAMPLES

The invention is described further with reference to the following Examples:

EXAMPLE 1

A series of tests were conducted on a two-combustion zone incinerator to determine the parameters required for efficient operation. The incinerator was fed with solid domestic waste which was incinerated under varying excess air values and the effect on the flue gas composition and auxiliary fuel consumption was determined. Further, the temperature of the secondary combustion zone was varied and the effect of the variation on carbon monoxide and hydrocarbon concentration in the flue gas was determined. The results obtained were plotted graphically and these graphs appear as FIGS. 3 to 7 hereto.

Figure 3:
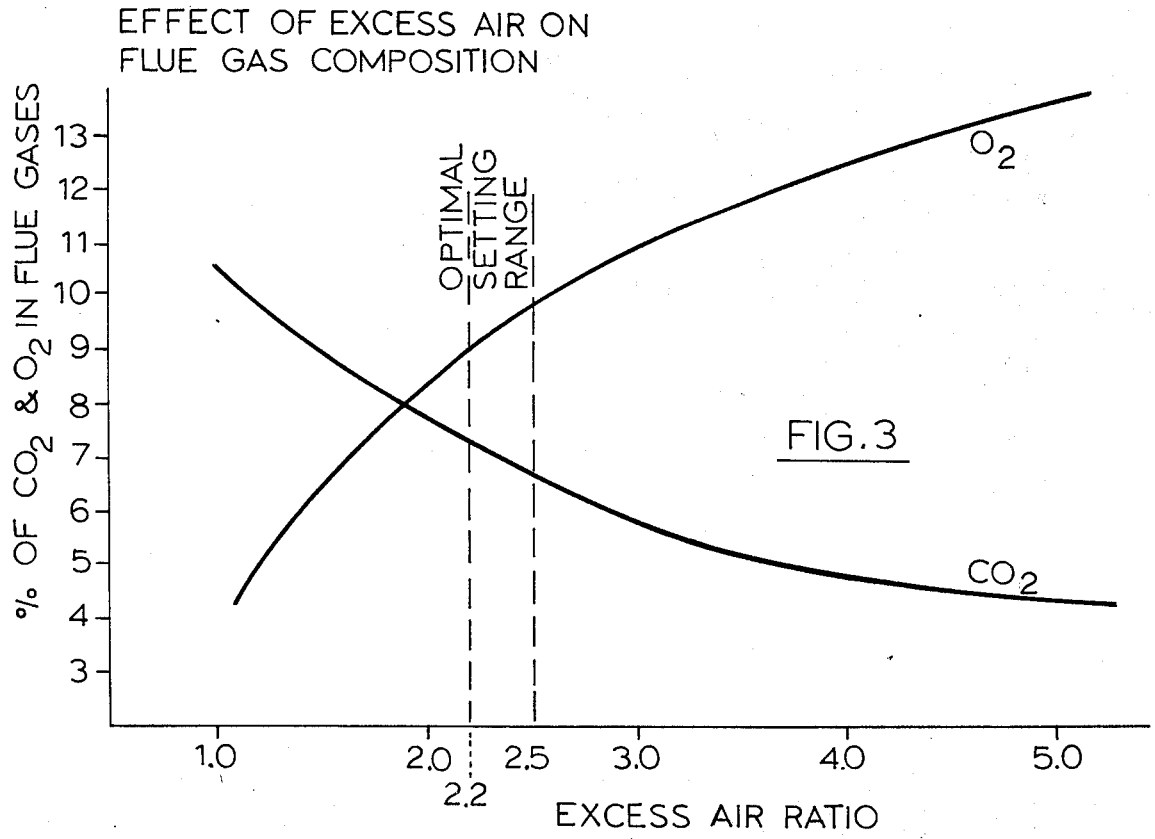
FIGS. 3 to 7 are graphical representations of the results of variation in operating parameters of an incinerator used in the waste treatment system of FIG. 1.
Figure 4:
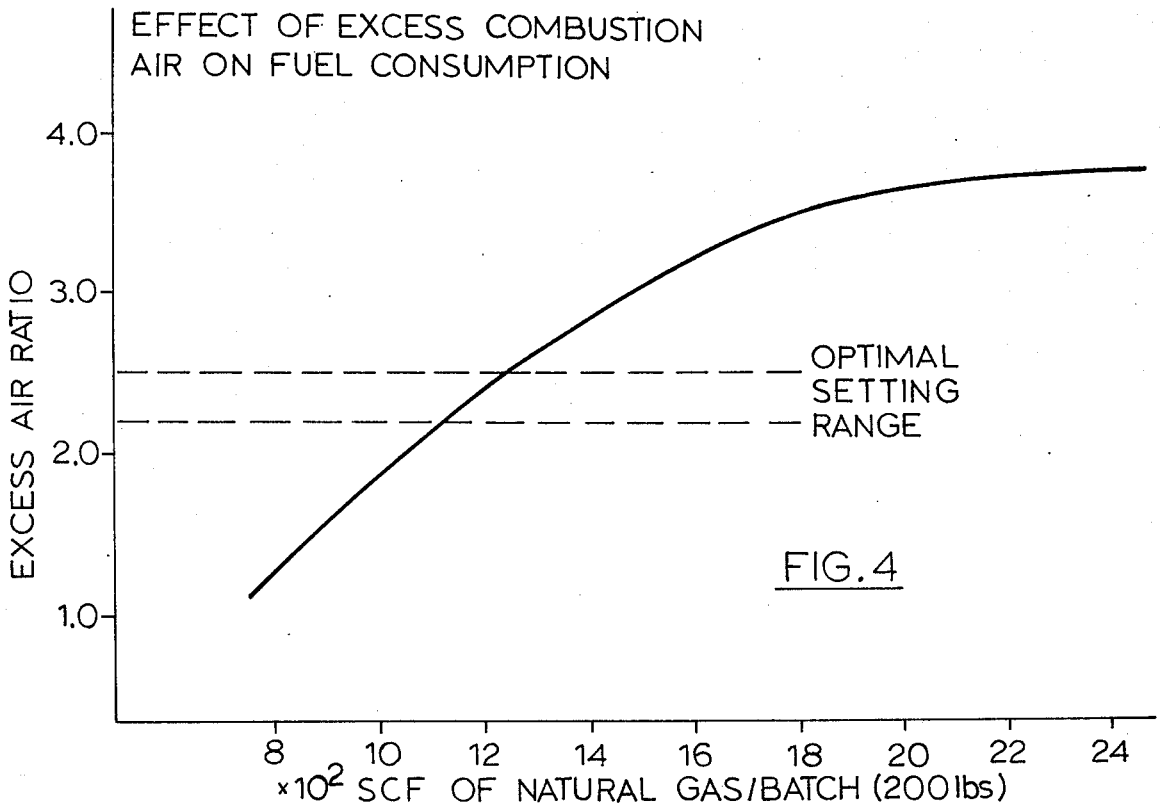
Figure 5:
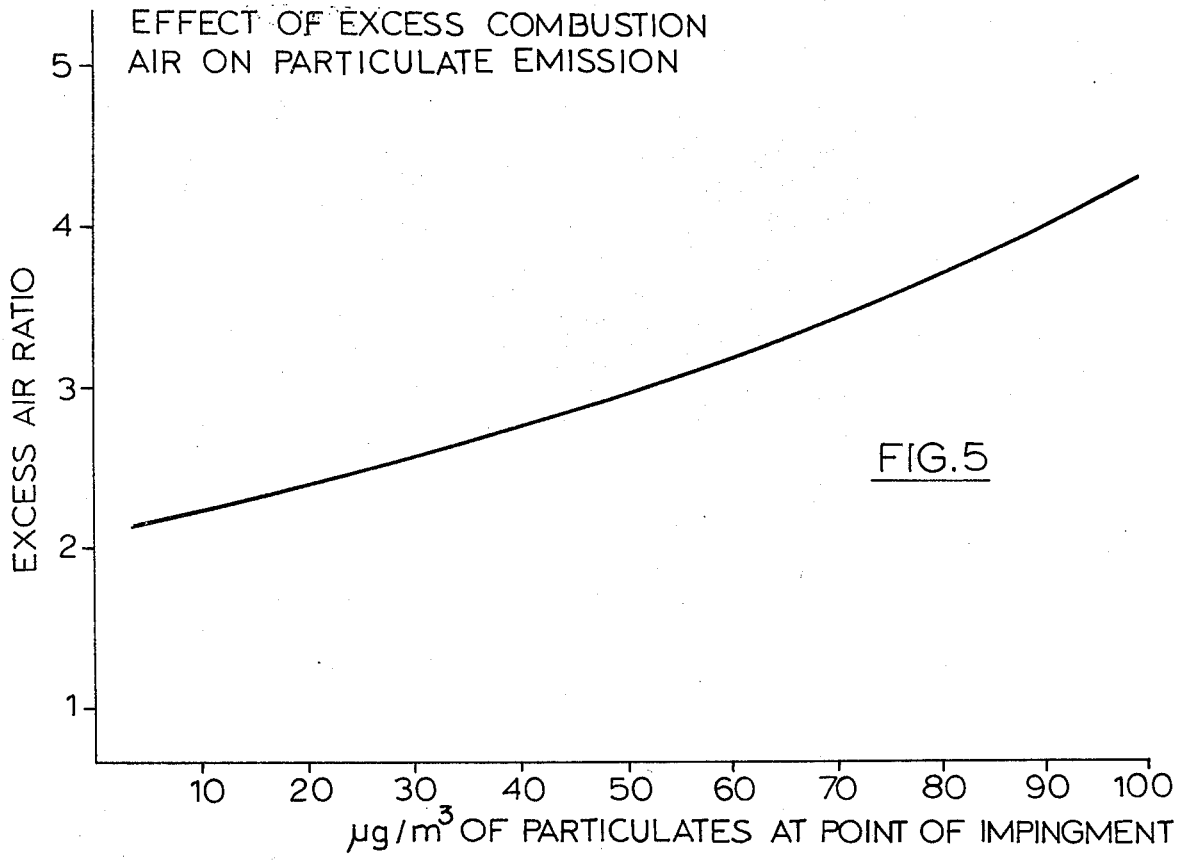
Figure 6:
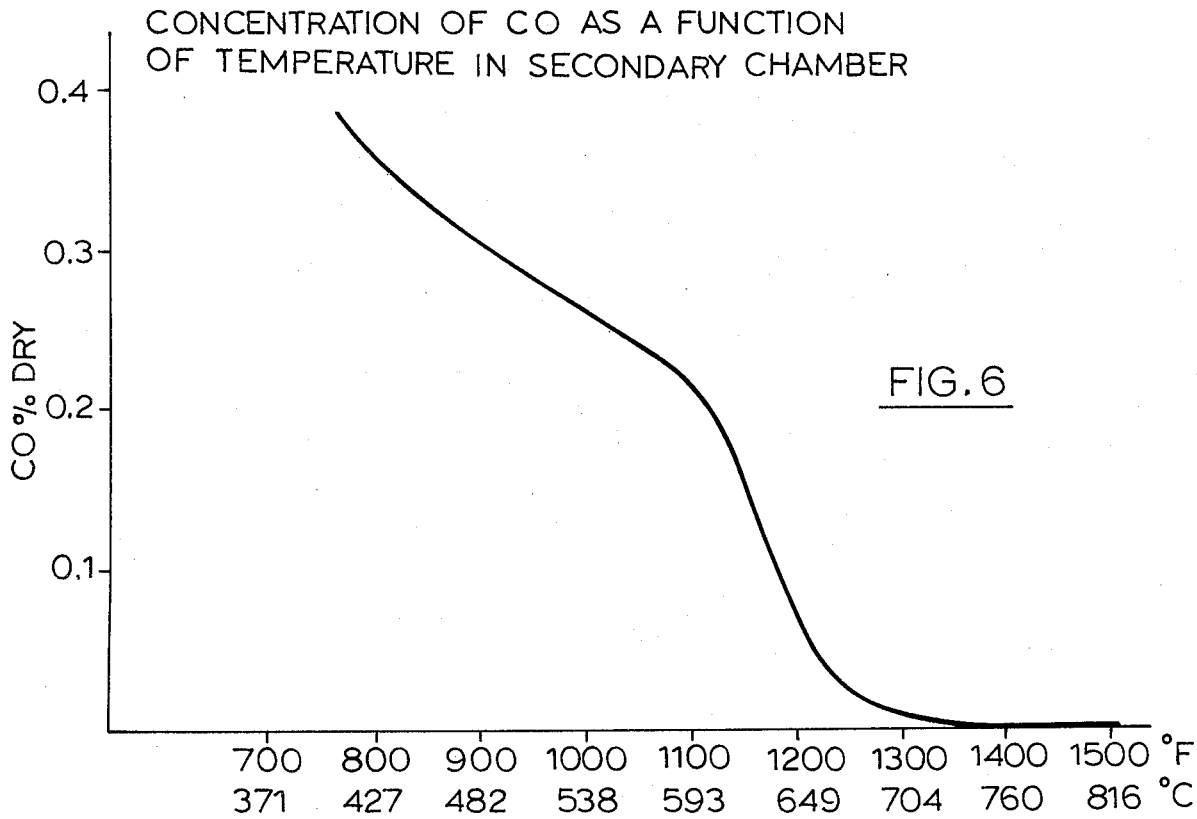
Figure 7:
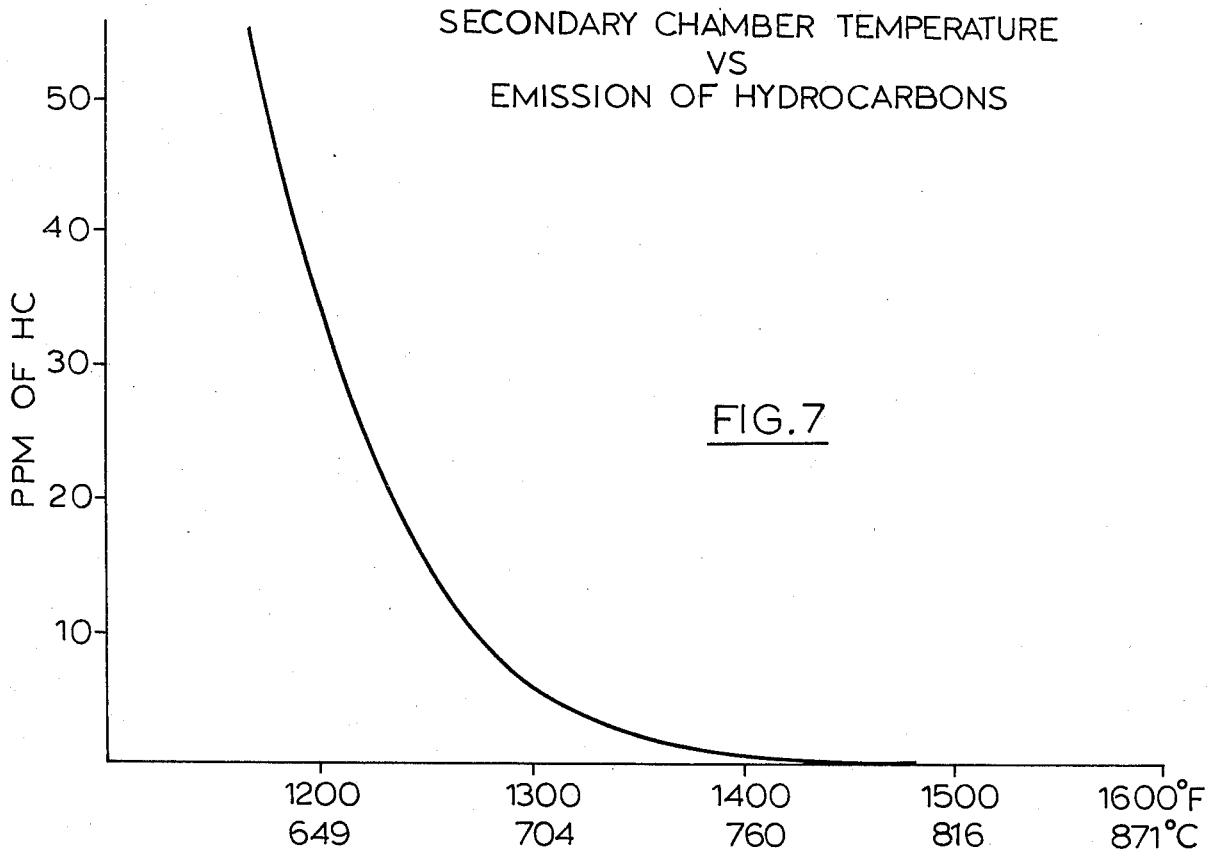

As may be seen from these graphs, as the excess air ratio increases;

i. the concentration of oxygen in the flue gas increases while the concentration of carbon dioxide decreases (FIG. 3);

ii. the fuel consumption increases (FIG. 4); and iii. the particulate emissions increase. Further, the concentration of carbon monoxide and hydrocarbon in the exhaust gas stream is negligible at secondary combustion zone temperatures in excess of about 1400° F (FIGS. 5 and 6).

On the basis of these results, and the parallel observation that a decrease in excess air resulted in increased concentrations of uncombusted material in the residual ash, the operating parameters discussed above in connection with incinerator 12 in FIG. 1 were arrived at as constituting the efficient balance of the various factors involved.

EXAMPLE 2

A waste treatment system was operated as a batch cycle on a pilot plant scale to treat domestic solid wastes and sludge and liquid wastes from a domestic liquid waste treatment process as outlined in the aforementioned U.S. Ser. No. 540,513. The waste treatment system tested was as described above with reference to FIG. 1, modified so that part of the condensate from condensor 50 recycles thereto through the heat exchanger 60 in analogous manner as illustrated in FIG. 2, and so that there was direct heat exchange between the heat exchanger 34 and the hot water heater 36. The following Tables IV to IX reproduce the experimental data obtained:

TABLE IV

| Overall Batch Cycle Performance | |
|---|---|
| Solid Waste Input | = 250 lbs. |
| Liquid Waste Input | = 510 lbs. |
| Cycle Duration | = 7.8 hours |
| Domestic Hot Water at 150° F | = 1624 Imperial Gallons |

TABLE IV-continued

| Overall Batch Cycle Performance | |
|---|---|
| Reclaimed Water (Condensate) | = 691 lbs. |
| Volume Reduction of Solid Wastes | = 92% |
| Average Calorific Value of Wastes | = 4,020 BTU/lb. |
| Auxiliary Fuel Used (Natural Gas) | = 1,550 s.c.f. |
| | = $1.404 \times 10^6$ BTU |
| Heat Supplied by Wastes | = $1.09 \times 10^6$ BTU |
| Heat Required to Evaporate Liquid Wastes and Sludge | = $0.53 \times 10^6$ BTU |
| Heat Reclaimed by Water Heater | = $1.624 \times 10^6$ BTU |
| Heat Reclaimed in Condensate | = 34,550 BTU |

TABLE V

| Incinerator 12 Parameters | |
|---|---|
| Natural Gas Heat Input | 180,000 BTU/Hr. |
| Solid Waste | 139,080 BTU/Hr. |
| Comb. Air Inlet Temperature | 70° F |
| Comb. Air Inlet Flow | 110 SCFM |
| Overall Excess Air | 101% |
| Incinerator Temperature | 1450° F |
| Combustion Gases Flow Rate | 540 ACFM |
| Pressure in Combustion Chamber | −0.08" W.C. |
| Solid Waste Combustion Rate | 30 lbs./hr. |
| Liquid Waste Disposal Rate | 11 lbs./hr. |
| Solid Waste Volume Reduction | 90% |
| Solid Waste Mass Reduction | 72% |

TABLE VI

| Water Preheater 66 Parameters | |
|---|---|
| Cold Water Inlet Temperature | 48° F |
| Cold Water Outlet Temperature | 88° F |
| Cold Water Flow Rate | 231 Imperial Gallons/hr. |
| Hot Water (Condensate) Inlet | 100° F |
| Hot Water Outlet | 60° F |
| Hot Water Flow Rate | 280 Imperial Gallons/hr. |
| Equivalent Waste Heat Utilization | 92,500 BTU/hr. |

TABLE VII

| Water Heater 36 Parameters | |
|---|---|
| Water Inlet Temperature | 88° F |
| Water Outlet Temperature | 140° F |
| Water Flow Rate | 231 Imperial Gallons/hr. |
| Flue Gases Inlet Temperature | 1450° F |
| Flue Gases Outlet Temperature | 645° F |
| Flue Gases Flow Rate | 555 Lbs./Hr. |
| SP. Heat of Flue Gases and Moisture Inlet | 0.292 BTU/lb.° F |
| SP. Heat of Flue Gases and Moisture Outlet | 0.271 BTU/lb.° F |
| Equivalent Waste Heat Utilization | 115,600 BTU/hr. |
| Pressure Drop | 0.3 in. W.C. |

TABLE VIII

| Liquid Waste Evaporator 44 Parameters | |
|---|---|
| Flue Gases Inlet Temperature | 645° F |
| Flue Gases Outlet Temperature | 166° F |
| Flue Gases Inlet Mass Flow Rate | 555 lbs./hr. |
| Flue Gases Outlet Mass Flow Rate | 608 lbs./hr. |
| Heat Content of Inlet Flue Gases | 175 BTU/lb. |
| Heat Content of Outlet Flue Gases | 46 BTU/lb. |
| Condensate Recirculation Rate | 540 lbs./hr. |
| Rate of Evaporation | 53 lbs./hr. |
| Evaporator Liquid Spray Temperature | 140° F |
| Equivalent Waste Heat Utilization | 61,000 BTU/hr. |
| Pressure Drop | 2.6 in W.C. |

TABLE IX

| CONDENSER 50 PARAMETERS | |
|---|---|
| Flow Rate of Cooling Water | 5.2 Imperial Gallons/min. |
| Temperature of Cool Water | 60° F |

TABLE IX-continued

| CONDENSER 50 PARAMETERS | |
|---|---|
| Temperature of Condensate | 100° F |
| Flow Rate of Flue Gases Inlet | 608 lbs./hr. |
| Flow Rate of Flue Gases Outlet | 520 lbs./hr. |
| Rate of Water Reclamation | 88 lbs./hr. |
| Temperature of Flue Gases Inlet | 166° F |
| Temperature of Flue Gases Outlet | 85° F |
| Pressure Drop | 3.9 in W.C. |

Based on the information contained in the above Tables IV to IX, it will be seen that the thermal efficiency expressed as $$\frac{\text{Total heat recovered (Hot water + condensate)}}{\text{Total heat consumed (Fuel + wastes)}}$$

was 66.5 %.

EXAMPLE 3

Based on the experimental data of Examples 1 and 2, the operating parameters for a continuously operating waste treatment system as described above with reference to FIG. 1 for a nominal population of 1,000 people were determined. The solid waste, mixed with sludge waste, is to be fed in a continuous batch manner. The following Tables X to XVI reproduce the parameters so determined and the projected performance data:

TABLE X

| Overall System Performance | |
|---|---|
| Solid waste input | 200 lbs./hr. |
| Liquid waste disposal (from waste water treatment) | 400 lbs./hr. |
| Sewage sludge disposal (from waste water treatment | 33 lbs./hr. |
| Domestic hot water at 140° F | 1000 Imperial Gallons/hr. |
| Average calorific value of wastes | 860,000 BTU/hr. |
| Auxiliary fuel used | 350,000 BTU/hr. |
| Heat reclaimed | 855,000 BTU/hr. |
| Nominal solid waste volume reduction | 90% |
| Nominal solid waste mass reduction | 75% |
| Overall system thermal efficiency (as defined on page 16) | 71% |

TABLE XI

| Incinerator 12 | |
|---|---|
| Solid waste input | 200 lbs./hr. |
| Calorific value of solid waste nominal | 4,300 BTU/hr. |
| Concentrated liquid waste input | 40 lbs./hr. |
| Sewage sludge disposal | 33 lbs./hr. |
| Air inlet temperature | 70° F |
| Total heat output value of solid waste | 860,000 BTU/hr. |
| Total heat value of auxiliary fuel input in primary burner (start-up only) and in after burner | 350,000 BTU/hr. |
| Excess air for waste combustion | 130% |
| Excess air for fuel combustion | 20% |
| Pressure in combustion chamber | −0.10 in. W.C. |
| Secondary chamber flue gas exit temperature | 1600° F |
| Nominal flue gas flow rate | 1900 lbs./hr. |
| Nominal solid waste volume reduction | 90% |
| Nominal solid waste mass reduction | 75% |
| Heat losses in ashes | approximately 10,000 BTU/hr. |
| Radiative heat losses | approximately 70,000 BTU/hr. |

TABLE XII

| Heat Exchanger Shell (34) | |
|---|---|
| Flue gas inlet temperature | 1600° F |
| Flue gas outlet temperature | 875° F |
| Flue gas flue rate | 1900 lbs./hr. |
| **Immersion Heater Coil (38)** | |
| Circulation water flow rate | 27,500 lbs./hr. |
| Water inlet temperature | 180° F |
| Water outlet temperature | 195° F |
| Operating pressure | 30 psig |
| Design pressure | 125 psig |
| Heater thermal efficiency | 0.95 |

TABLE XIII

| Hot water tank (36) | |
|---|---|
| Inlet temperature | 100° F |
| Outlet temperature | 140° F |
| Nominal flow rate | 10,000 lbs./hr |
| Nominal heat recovery | 400,000 BTU/hr. |
| Nominal heat loss | 8,000 BTU/hr. |

TABLE XIV

| Evaporator - Cooler (44) | |
|---|---|
| Flue gas inlet temperature | 875° F |
| Flue gas flow rate | 1900 lbs./hr. |
| Liquid recirculation rate | 3000 lbs./hr. |
| Liquid evaporation rate | 360 lbs./hr. |
| Nominal flue gas outlet temperature | 160° F |
| Specific humidity of outlet flue gas | 0.25 lbs.$H_2O$/lb.dry gas |
| Flue gas mass flow rate | 2260 lbs./hr. |
| Heat utilization | 378,000 BTU/hr. |
| Nominal heat loss | 10,000 BTU/hr. |

TABLE XV

| Condensor (50) | |
|---|---|
| Flue gas inlet temperature | 160° F |
| Flue gas inlet flow rate | 2260 lb./hr. |
| Flue gas inlet specific humidity | 0.25 lb.$H_2O$/lb.dry gas |
| Exhaust gas outlet temperature (nominal) | 70° F |
| Exhaust gas flow rate | 1827 lbs./hr. |
| Exhaust gas specific humidity | 0.015 lb.$H_2O$/lb.dry gas |
| Rate of water reclamation | 433 lb./hr. |
| Heat extracted from flue gases | 495,000 BTU/hr. |
| Condensate temperature (nominal) | 110° F |
| Nominal heat loss | 15,000 BTU/hr. |

TABLE XVI

| Water Preheater (66) | |
|---|---|
| Water inlet temperature (nominal) | 55° F |
| Water outlet temperature (nominal) | 100° F |
| Flow rate | 10,000 lbs./hr. |
| Scrubber condensate inlet temperature | 110° F |
| Condensate outlet temperature | 65° F |
| Condensate flow rate | 10,100 lbs./hr. |
| Heat reclaimed | 455,000 BTU/hr. |

SUMMARY

It will be seen, therefore, that the present invention provides an on-site waste disposal system which efficiently incinerates solid wastes and recovers the heat value thereof, discharges cool and environmentally pure gaseous products and sterile ash, decreases substantially the volume and mass of solid material to be disposed of, and may be integrated with an on-site waste water treatment system to achieve disposal of excess sludge from the waste water treatment and achieve disposal of waste water from the waste water treatment system. Modifications are possible within the scope of the invention.

We claim:

1. A method of waste disposal, which comprises:

feeding solid waste to an incinerator having a primary combustion zone and a secondary combustion zone in fluid-flow relationship with said primary combustion zone, said solid waste having a calorific value of about 3500 to 6000 BTU per lb, a bulk density of about 4.0 to about 10 lbs/cu ft, a moisture content of about 10 to about 35 percent by weight and comprising a plurality of refuse components consisting of:

about 40 to about 65 percent by weight of paper waste, about 5 to about 35 percent by weight of food waste, about 1 to about 9 percent by weight of rubber, plastic and leather wastes, about 0.1 to about 11 percent by weight of textile wastes, 0 to about 20 percent by weight of garden wastes, and about 10 to about 30 percent by weight of incombustible solids, feeding an oxygen-containing gas to said primary combustion zone, igniting said solid waste to a self-sustaining burning condition, burning substantially completely the combustible portion of said ignited solid waste in the presence of said oxygen-containing gas to produce a flue gas product containing unused oxygen, carbon dioxide, carbon monoxide, volatile hydrocarbons and entrained particulate solids and an environmentally sterile ash comprising said uncombustible solids, recovering said ash from said primary combustion zone, flowing said flue gas product through said secondary combustion zone, feeding an oxygen containing gas to said secondary combustion zone, heating said flue gas product in said secondary combustion zone in the presence of said oxygen-containing gas to cause oxidation of said carbon monoxide and hydrocarbons to carbon dioxide, removing a hot flue gas from said secondary combustion zone, controlling the flow of said oxygen-containing gas to said primary combustion zone and the temperature of said hot flue gas exiting said secondary combustion zone to achieve i. substantially complete combustion of combustibles in said solid waste, ii. substantially complete conversion of carbon monoxide and hydrocarbon in said flue gas to carbon dioxide in said flue gas exiting said secondary combustion zone, iii. minimization of fuel consumption in said heating in said secondary combustion zone, and iv. minimization of entrained particulates solids concentration in said flue gas exiting said second combustion zone, utilizing a substantial proportion of the calorific value of heat in said hot flue gas while cooling said flue gas to a temperature below about 100° F, scrubbing said flue gas during said cooling thereof substantially free from entrained particulate matter and any water soluble gaseous products, and discharging a cool and environmentally pure flue gas stream.

2. The method of claim 1, wherein temperature of said flue gas exiting in said secondary combustion zone is controlled to a value of about 1400° F to about 1800° F.

3. The method of claim 2 wherein the flow of said oxygen-containing gas to said primary combustion zone is controlled to provide a stoichiometric excess of oxygen over that theoretically required to completely combust the combustible material in said wastes of about 120 to about 150 percent.

4. The method of claim 1, including sensing the oxygen concentration and/or carbon dioxide concentration in said hot flue gas exiting the secondary combustion zone, and conducting said controlling of the flow of said oxygen-containing gas to said primary combustion zone and the temperature of flue gas exiting said secondary combustion zone to maintain a reused concentration of oxygen of about 9 to about 9.8 percent and/or a reused concentration of carbon dioxide of about 6.7 to 7.4 percent and to achieve a combustible-material content of said ash of less than about 2 percent by weight and a putrescible-material content of said ash of less than about 1 percent by weight.

5. The method of claim 1, wherein said calorific value of said flue gas is used to heat water from a temperature of about 50° to about 180° F.

6. The method of claim 1, including the further steps of: collecting said solid waste from a multiple number of dwellings having a domestic hot water supply system prior to said feed to said incinerator, and passing said hot flue gas into heat exchange relationship with an inlet water feed for said domestic hot water supply system to achieve said calorific value utilization and cooling of said flue gases by providing at least part of the heat required by said hot water supply system.

7. The method of claim 1, including maintaining said primary combustion zone under a subatmospheric pressure of about 0.005 to about 0.1 in w.c.

8. The method of claim 1, including subjecting domestic liquid wastes to renovation procedures producing excess sludge waste and waste water, feeding said sludge wastes to said incinerator, feeding said solid wastes to said incinerator in continuous batch fashion, passing said hot flue gas into heat exchange relationship with an inlet water feed for a domestic hot water system for the source of said solid and liquid wastes to heat said inlet water feed, passing said partially cooled flue gas into intimate countercurrent contact with said waste water from said renovation procedures having a cooler temperature than said cooled flue gas to evaporate water therefrom and cool further said flue gas and result in concentrated waste water and a further cooled flue gas laden with water vapor, forwarding said concentrated waste water to said incinerator, spraying the same into said primary combustion zone to achieve incineration of said sprayed concentrated waste water, passing said further cooled flue gas into countercurrent contact with a cooler condensing liquid to cause condensation of water vapor from said further cooled flue gas, cooling of said flue gas to a temperature less than about 100° F and said scrubbing of said flue gas to remove residual entrained particulate matter and water-soluble gaseous products, passing said flue gas of a temperature less than 100° F through a vacuum inducer which maintains said incinerator under a subatmospheric pressure of about 0.005 to about 0.1 in w.c., prior to said discharge of said flue gas, passing reclaimed water from said latter countercurrent contact into heat exchange relationship with cold potable water of temperature less than said reclaimed water to warm said potable water, using said warmed potable water as said inlet water feed, and passing the reclaimed water to said renovation procedures, whereby said steps of first heat exchange, first countercurrent contact, second countercurrent contact and second heat exchange achieve said utilization of a substantial proportion of the calorific value of the heat in said flue gas and said cooling of said flue gas stream to a temperature below about 100° F.

9. The method of claim 8, wherein said flue gas exiting said second combustion zone has a temperature of about 1400° to about 1800° F, said flue gas has a temperature of about 600° to about 1000° F after said first heat exchange, said flue gas has a temperature of about 130° to about 180° F after said first countercurrent contact, said condensing liquid has a temperature of about 50° to about 80° F, said reclaimed water has a temperature of about 90° to about 120° F, said cold potable water has a temperature of about 50° to about 70° F, said inlet water feed has a temperature of about 90° to about 110° F, and said inlet water feed after said heating thereof has a temperature of about 120° to about 180° F.

10. The method of claim 9, wherein about 30 to about 50 percent of the recoverable heat in the flue gas is used in said first heat exchange, about 15 to 30 percent of the recoverable heat in the flue gas is used in said evaporation, and the latent heat of evaporated water and the remainder of the recoverable heat are recovered in said second countercurrent contact.

* * * * *